US011686161B2

(12) United States Patent
Biddick et al.

(10) Patent No.: US 11,686,161 B2
(45) Date of Patent: Jun. 27, 2023

(54) SYSTEM AND METHOD OF TRANSFERRING POWER WITHIN A WELLBORE

(71) Applicant: Upwing Energy, Inc., Cerritos, CA (US)

(72) Inventors: David Biddick, Houston, TX (US); Patrick McMullen, Cerritos, CA (US)

(73) Assignee: Upwing Energy, Inc., Cerritos, CA (US)

( * ) Notice: Subject to any disclaimer, the term of this patent is extended or adjusted under 35 U.S.C. 154(b) by 0 days.

(21) Appl. No.: 16/235,832

(22) Filed: Dec. 28, 2018

(65) Prior Publication Data

US 2020/0208473 A1 Jul. 2, 2020

(51) Int. Cl.

| | |
|---|---|
| ***E21B 17/02*** | (2006.01) |
| ***E21B 4/04*** | (2006.01) |
| ***E21B 41/00*** | (2006.01) |
| *E21B 47/13* | (2012.01) |

(52) U.S. Cl.

CPC ..... *E21B 17/028* (2013.01); *E21B 4/04* (2013.01); *E21B 41/0085* (2013.01); *E21B 47/13* (2020.05)

(58) Field of Classification Search

CPC ..... E21B 17/028; E21B 4/04; E21B 41/0085; E21B 47/122

See application file for complete search history.

(56) References Cited

U.S. PATENT DOCUMENTS

| | | | |
|---|---|---|---|
| 5,216,308 | A | 6/1993 | Meeks |
| 5,620,048 | A | 4/1997 | Beauquin |
| 6,167,965 | B1 | 1/2001 | Bearden et al. |
| 6,557,642 | B2 | 5/2003 | Head |
| 9,970,250 | B2 | 5/2018 | Hess et al. |
| 2001/0050173 | A1 | 12/2001 | Head |
| 2003/0132003 | A1 | 7/2003 | Arauz et al. |
| 2005/0263289 | A1* | 12/2005 | Kanady ..... F04C 13/008 166/369 |
| 2006/0243450 | A1 | 11/2006 | Head |
| 2007/0277969 | A1 | 12/2007 | Hall |
| 2008/0060846 | A1* | 3/2008 | Belcher ..... E21B 47/06 175/25 |
| 2009/0025943 | A1 | 1/2009 | Clark et al. |
| 2009/0078426 | A1 | 3/2009 | Blaquiere |
| 2011/0011596 | A1 | 1/2011 | Martinez |
| 2011/0021498 | A1 | 1/2011 | Stokes et al. |
| 2011/0176941 | A1 | 7/2011 | Albers et al. |
| 2013/0043019 | A1 | 2/2013 | Hansen |
| 2013/0341033 | A1 | 12/2013 | Carstensen et al. |

(Continued)

OTHER PUBLICATIONS

Al-Khalifa et al., 'ESP Reliability Lessons Learned from Three H2S Saudi Arabian Fields,' Society of Petroleum Engineers, SPE-184176-MS, Nov.-Dec. 2016, 13 pages.

*Primary Examiner* — D. Andrews
*Assistant Examiner* — Yanick A Akaragwe
(74) *Attorney, Agent, or Firm* — Fish & Richardson P.C.

(57) ABSTRACT

A multi-phase, inductive coupling first portion is carried by a tubular. The coupling first portion is configured to inductively transmit current with a corresponding multi-phase, inductive coupling second portion. A downhole-type electric stator is carried by the tubular and is configured to receive and electromagnetically interact with an electric rotor-impeller. The coupling first portion is electrically connected to windings of the stator.

23 Claims, 10 Drawing Sheets

(56) References Cited

U.S. PATENT DOCUMENTS

| | | | |
|---|---|---|---|
| 2014/0020907 | A1 | 1/2014 | Head |
| 2015/0136424 | A1 | 5/2015 | Hughes et al. |
| 2015/0184487 | A1 | 7/2015 | Osborne |
| 2017/0081925 | A1 | 3/2017 | Brown et al. |
| 2017/0183935 | A1 | 6/2017 | Brown et al. |
| 2018/0045193 | A1 | 2/2018 | Tanner |
| 2018/0066479 | A1 | 3/2018 | Head et al. |
| 2020/0056615 | A1* | 2/2020 | Xiao ..... F04D 1/04 |

* cited by examiner

SYSTEM AND METHOD OF TRANSFERRING POWER WITHIN A WELLBORE

TECHNICAL FIELD

This disclosure relates to exchanging power to and/or from downhole equipment.

BACKGROUND

Most wells behave characteristically different over time, as well as seasonally, due to geophysical, physical, and chemical changes in the subterranean reservoir that feeds the well. For example, it is common for well production to decline as the well reaches the end of its life. This decline in production is due to declining pressures in the reservoir, and can eventually reach a point where there is not enough pressure in the reservoir to push production through the well to the surface. In some wells, a top side compressor or pump is sometimes used to extend the life of the well by decreasing pressure at the top of the well. In some instances, an artificial lift system, such as an electric submersible pump, can be installed within the wellbore to a similar effect. This decrease in pressure decreases the pressure head on the production flow to the surface, enabling the well to continue producing when the reservoir pressures have dropped too low to drive the production to the surface. Some production wells can only be feasibly produced with such artificial lift systems. Well devices, such as electric submersible pumps (ESP), downhole compressors, and other powered downhole devices utilize electric power. This power is supplied from a topside facility, either from the electric grid or by local generation and/or storage. Such storage can include batteries, capacitors, flywheels, or any other energy storage device. To facilitate transmitting power from the topside down into the well for use by the downhole device, cables are typically used. When the device is first lowered into the well, cables can be attached and extended with the production tube. They can also be lowered independently and connected via wet mate connectors.

SUMMARY

This disclosure describes technologies relating to transferring power to and/or from equipment located downhole equipment.

An example implementation of the subject matter described within this disclosure is a downhole-type artificial lift component with the following features. A multi-phase, inductive coupling first portion is carried by a tubular. The coupling first portion is configured to inductively transmit current with a corresponding multi-phase, inductive coupling second portion. A downhole-type electric stator is carried by the tubular and is configured to receive and electromagnetically interact with an electric rotor-impeller. The coupling first portion is electrically connected to windings of the stator.

Aspects of the example implementation, which can be combined with the example implementation alone or in part, include the following. The multi-phase, inductive second portion is electrically connected to a power source at a topside facility. The multi-phase, inductive second portion is positioned on a side of the tubular.

Aspects of the example implementation, which can be combined with the example implementation alone or in part, include the following. The downhole-type artificial lift component further includes the multi-phase, inductive second portion. A multi-phase, inductive third portion is electrically connected to the second portion. A multi-phase, inductive fourth portion is configured to inductively transmit current with a corresponding multi-phase, inductive coupling third portion electrically connected to the multi-phase, inductive fourth portion.

Aspects of the example implementation, which can be combined with the example implementation alone or in part, include the following. A first casing section and a second casing section are included. The multi-phase, inductive fourth portion is positioned at an uphole end of first casing. The multi-phase, inductive third portion is positioned at a downhole end of the second casing section. The second and third portion are configured to be positioned in proximity to one another once installed.

Aspects of the example implementation, which can be combined with the example implementation alone or in part, include the following. Each phase of one of the multi-phase inductive couplings share a common line.

Aspects of the example implementation, which can be combined with the example implementation alone or in part, include the following. The multi-phase, inductive first coupling portion and the multi-phase, inductive coupling second portion are both 3-phase.

Aspects of the example implementation, which can be combined with the example implementation alone or in part, include the following. The tubular is a casing and the multi-phase, inductive coupling second portion is positioned between a wall of the wellbore and the casing.

Aspects of the example implementation, which can be combined with the example implementation alone or in part, include the following. The tubular is a production tubing and the multi-phase, inductive coupling second portion is positioned between an inner surface of a casing and the production tubing.

Aspects of the example implementation, which can be combined with the example implementation alone or in part, include the following. The tubular includes a transmission portion configured to increase a power transmission efficiency when compared to a remaining portion of the tubular.

Aspects of the example implementation, which can be combined with the example implementation alone or in part, include the following. The transmission portion includes a non-magnetic material.

Aspects of the example implementation, which can be combined with the example implementation alone or in part, include the following. The transmission portion includes a non-metallic material.

Aspects of the example implementation, which can be combined with the example implementation alone or in part, include the following. The transmission portion has a reduced wall thickness when compared to the remaining portion of the tubular.

Aspects of the example implementation, which can be combined with the example implementation alone or in part, include the following. The second portion is encased by the transmission portion on a first side and by a pressure retaining casing on remaining sides. The pressure retaining casing configured to retain pressure within the tubular.

An example implementation of the subject matter described within this disclosure is a method with the following features. Current is inductively transmitted between a multi-phase, inductive coupling first portion and a multi-phase, inductive coupling second portion while the coupling portions are residing downhole. Current is transmitted between the coupling first portion and windings of an electric stator. An electric rotor-impeller is supported to rotate within the stator.

Aspects of the example implementation, which can be combined with the example implementation alone or in part, include the following. Current is inductively transmitted between a multi-phase, inductive coupling third portion and a multi-phase, inductive coupling fourth portion. The third portion is connected to the second portion.

Aspects of the example implementation, which can be combined with the example implementation alone or in part, include the following. The fourth portion is electrically connected to a topside power source.

Aspects of the example implementation, which can be combined with the example implementation alone or in part, include the following. Inductively transmitting includes transmitting across a portion of a tubular.

Aspects of the example implementation, which can be combined with the example implementation alone or in part, include the following. The portion of the tubular includes a non-magnetic material.

Aspects of the example implementation, which can be combined with the example implementation alone or in part, include the following. The portion of the tubular includes a non-metallic material.

Aspects of the example implementation, which can be combined with the example implementation alone or in part, include the following. The portion of the tubular includes a thinner wall section in comparison with the rest of the tubular.

An example implementation of the subject matter described within this disclosure is a downhole-type system with the following features. A multi-phase, inductive coupling first portion is carried by a tubular. A multi-phase, inductive coupling second portion is included. The first portion is configured to inductively transmit current with the corresponding multi-phase, inductive coupling second portion. A downhole-type electric stator is carried by the tubular and is configured to receive and electromagnetically interact with an electric rotor-impeller. The coupling first portion is electrically connected to windings of the stator.

Aspects of the example implementation, which can be combined with the example implementation alone or in part, include the following. The multi-phase, inductive coupling first portion and the multi-phase, inductive coupling second portion are both 3-phase.

The details of one or more implementations of the subject matter are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Power cables used in downhole applications, such as for powering an electric submersible pump (ESP), must be protected from the caustic fluids in the well if it is being exposed to them. In doing so, the cable becomes very expensive and difficult to work with. Connections are a significant weak point in reliability for such systems. Even if cables are deployed in the annulus (between well casing and production tubing) and the annulus is flooded with a non-corrosive fluid, a connection through the pressure seal to the device, which is in the production fluid, is needed. Failures in this electric system are common and one of the leading causes of device failure. Once a connector fails, the whole device (connected to the production tubing string) needs to be recovered to the surface and repaired.

This disclosure relates to multi-phase, inductive coupling portions permanently installed within a wellbore. In certain instances, such installation allows for a long portion of the primary power cables to be shielded from the corrosive fluid flow within the wellbore, and eliminates the need for connectors and associated seals that are prone to failure. A portion of the multi-phase inductive coupler can be installed in the annulus between the casing and the wall of the wellbore. Power can be provided to the permanently installed coupler portions from a topside facility. Downhole-type rotating equipment (ESP, downhole compress, downhole generator, etc.) is installed such that a corresponding coupler portion on the equipment is adjacent to the permanently installed coupler portion. In some implementations, the portion of the casing adjacent to the permanently installed coupler portion can be configured, with materials, geometry, and other criteria, to improve power transmission across the casing between coupling portions.

Figure 1:
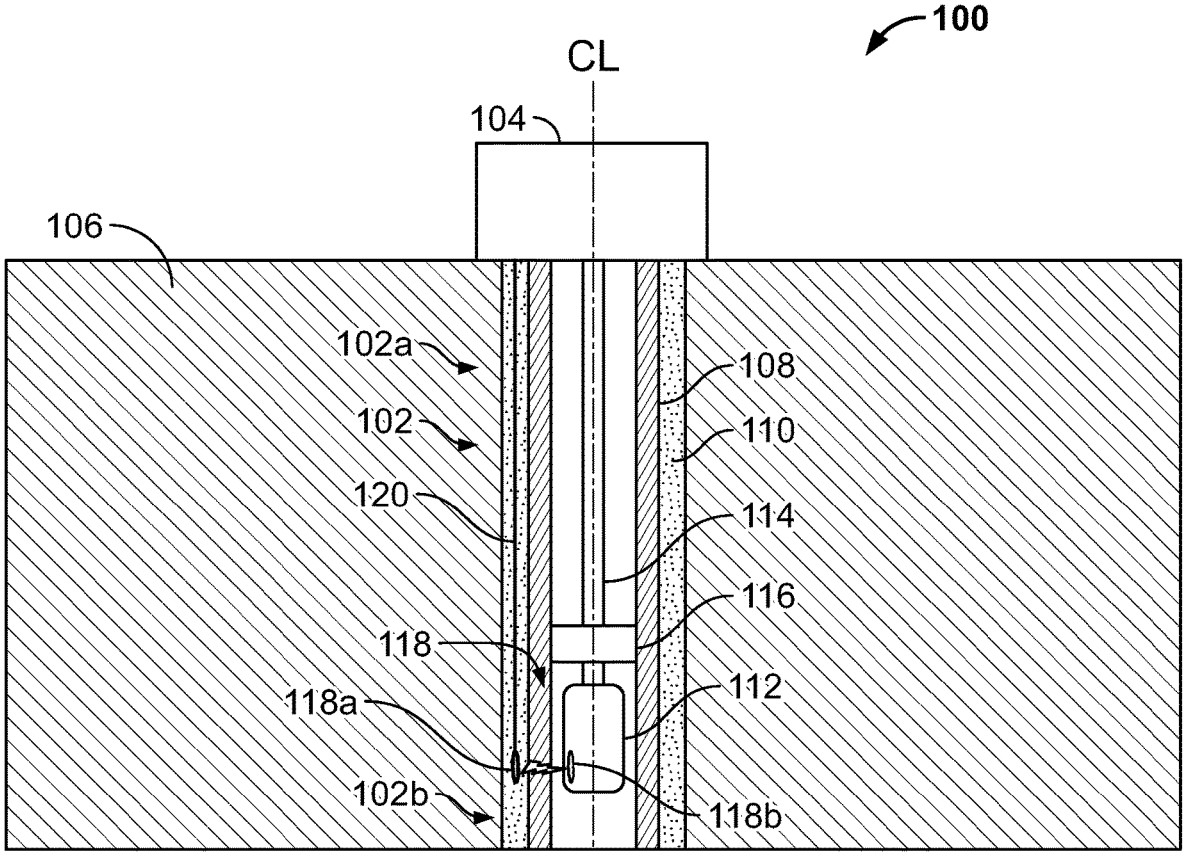
FIG. 1 is a half-cross sectional diagram of an example well system that can be used with aspects of this disclosure.

FIG. 1 depicts an example well system 100 constructed in accordance with the concepts herein. The well system 100 includes a wellbore 102 that extends from a topside facility 104, outside the wellbore 102, into a subterranean zone 106. The well system 100 can be used to produce fluids from the subterranean zone 106 to the topside facility 104. Additionally or alternatively, fluids can be injected into the subterranean zone 106 from the topside facility 104. For simplicity's sake, the wellbore 102 is shown as a vertical wellbore, but in other instances, the wellbore 102 can be a deviated wellbore with the wellbore deviated from vertical (for example, horizontal or slanted). The well system 100 can include multiple wellbores, forming a multilateral well (that is, a well having multiple lateral wells branching off another well or wells).

In some implementations, the well system 100 is used in producing natural gas from the subterranean zone 106 to the topside facility 104. While such a system is sometimes termed a "gas well," the well system 100 need not produce only dry gas, and may incidentally or in much smaller quantities, produce liquid including oil and/or water. In some implementations, the well system 100 is used in producing crude oil from the subterranean zone 106. While such a system is sometimes termed an "oil well," the well system 100 not need produce only crude oil, and may incidentally or in much smaller quantities, produce gas and/or water. In some implementations, the production from the well system 100 can be multiphase in any ratio, and/or can produce mostly or entirely liquid at certain times and mostly or entirely gas at other times. For example, in certain types of wells, it is common to produce water for a period of time to gain access to the gas in the subterranean zone 106. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore 102 is typically, although not necessarily, cylindrical. All or a portion of the wellbore 102 is lined with a tubing, such as casing 108. The casing 108 lines all or part of the wellbore 102. The casing 108 operates to isolate the bore of the wellbore 102, defined in the cased portion of the wellbore 102 by the inner bore of the casing 108, from the surrounding subterranean zone 106. The casing 108 can be formed of a single continuous tubing or multiple lengths of tubing joined (for example, threadedly and/or otherwise) end-to-end of the same size or of different sizes. The casing 108 can be secured by cement 110 in the wellbore, for example, by flowing cement 110 into the annulus between the casing 108 and the wall of the wellbore 102. In some implementations, the casing 108 is omitted or ceases in portions of the wellbore 102. Such portions without casing 108 are often referred to as "open hole."

FIG. 1 shows the well system 100 being produced with a topside facility 104. The topside facility 104 includes valves, separators, supplemental pumps and compressors, and any other equipment needed to produce the well system 100. The well system 100 also includes an artificial lift device 112 residing in the wellbore 102. The artificial lift device 112, being of a type configured in size and of robust construction for installation within a wellbore 102, can include any type of pump, compressor, or blower that can assist production of fluids to the topside facility 104 by creating an additional pressure differential within the wellbore 102. Also, notably, while the concepts herein are discussed with respect to an ESP, they are likewise applicable to other types of pumps, compressors, blowers and devices for moving multi-phase fluid. Alternatively or in addition, the concepts herein are likewise applicable to downhole-type generators. Such generators convert the kinetic energy of a moving fluid into electricity during operation.

In certain instances, casing 108 can be of a type commercially produced in a number of common sizes specified by the American Petroleum Institute (the "API"), including 4½, 5, 5½, 6, 6⅝, 7, 7⅝, 16/8, 9⅝, 10¾, 11¾, 13⅜, 16, 116/8 and 20 inches, and the API specifies internal diameters for each casing size. One or more portions of the artificial lift device 112 can be configured to fit in, and (as discussed in more detail below) in certain instances, seal to the inner diameter of one of the specified API casing sizes. Of course, one or more portions of the artificial lift device 112 can be made to fit in and, in certain instances, seal to other sizes of casing or tubing or otherwise seal to a wall of the wellbore 102. As shown in FIG. 1, one or more portions of the artificial lift device 112 can be attached to a production tubing 114 in the well system 100. In some implementations, one or more portions of the artificial lift device 112 can be attached to the casing 108. Portions of the artificial lift device 112 do not need to reside within the production tubing 114 and can have dimensions that are larger than the inner diameter of the production tubing 114. The largest outer diameter of the artificial lift device 112 may therefore be larger than the inner diameter of the production tubing 114. Similarly, portions of the artificial lift device 112 do not need to reside within the casing 108 and can have dimensions that are larger than the inner diameter of the casing 108. The largest outer diameter of the artificial lift device 112 may therefore be larger than the inner diameter of the casing 108.

Additionally, the construction of the components of the artificial lift device 112 are configured to withstand the impacts, scraping, and other physical challenges the artificial lift device 112 will encounter while being passed hundreds of feet/meters or even multiple miles/kilometers into and out of the wellbore 102. For example, in certain instances, the artificial lift device 112 can be disposed in the wellbore 102 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the artificial lift device 112 is configured to withstand and operate for extended periods of time (e.g., multiple weeks, months or years) at the pressures and temperatures experienced in the wellbore 102, which temperatures can exceed 400° F./205° C. and pressures over 10,000 pounds per square inch, and while submerged in the well fluids (gas, water, or oil as examples). Finally, the artificial lift device 112 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), or slickline (that is, a single stranded wire), and thus have a corresponding connector (for example, a jointed tubing connector, coiled tubing connector, or wireline connector).

As illustrated, a combination packer/hanger 116 integrated or provided separately with a downhole system, as shown with the artificial lift device 112, and divides the wellbore 102 into an uphole zone 102*a* above the combination packer/hanger 116 and a downhole zone 102*b* below the combination packer/hanger 116. Although shown in FIG. 1 as being located uphole of the artificial lift device 112, the combination packer/hanger 116 can optionally be located downhole of the artificial lift device 112. In some implementations, at least a portion of the combination packer/hanger can reside within the artificial lift device 112. While illustrated as a combination packer/hanger 116, the packer and hanger can be separate units in some implementations.

FIG. 1 shows a portion of the artificial lift device 112 positioned in the casing 108, and connected to the production string 114 of tubing within the wellbore 102. The combination packer/hanger 116 is configured to seal against the wall of the wellbore, for example, against the interior wall of the casing 108 in the cased portions of the wellbore. In some implementations, the combination packer/hanger 116 can seal against the interior wall of the wellbore 102 in the uncased, open-hole configuration. In certain instances, the combination packer/hanger 116 can form a gas and liquid-tight seal between the uphole portion 102*a* and the downhole portion 102*b*. For example, the combination packer/hanger 116 can be configured to at least partially seal against an interior wall of the wellbore to separate (completely or substantially) a pressure in the wellbore 100 downhole of the combination packer/hanger 116 from a pressure in the wellbore 102 uphole of the combination packer/hanger 116. For example, the combination packer/hanger 116 can include a production packer. In some implementations, the combination packer/hanger 116 is not required, such as when the production tubing supports the artificial lift device 112.

The well system 100 includes a multi-phase inductive power coupler 118 that includes a first portion 118*a* and a second portion 118*b*. The multi-phase inductive coupler first portion 118*a* is permanently installed within the wellbore 102 and is electrically connected to the topside facility 104 by one or more power cables 120. The one or more power cables 120 can be positioned in a variety of places without departing from this disclosure. For example, the one or more power cables 120 can be positioned between a wall of the wellbore 102 and an outer surface of the casing 108. In some implementations, the one or more power cables 120 can be cemented in place. In some implementations, the one or more power cables 120 can be strapped or clipped to the side of the casing 108. While illustrated as being positioned between a wall of the wellbore 102 and the outer surface of the casing 108, the one or more power cables 120 can be positioned in other parts of the wellbore; for example, the one or more power cables 120 can be strapped to the outer surface of any downhole tubular, such as a liner, casing, or production tube. In some implementations, the one or more power cables can be positioned between the production tubing and the casing 108 or a liner. In some implementations, the one or more power cables 120 can be integrated into a downhole tubular. In some implementations, the one or more power cables 120 can be located partially on the outer surface of a tubular and partially on an inner surface of the same tubular. In some implementations, multiple tubulars can be connected together, and the one or more power cables can be located on an outer surface of the multiple tubulars, on the inner surface of the multiple tubulars, or any combination across the multiple tubulars.

The multi-phase inductive coupler first portion 118*a* can be installed in a variety of ways, such as being cemented into the wellbore 102 within the annulus defined by the wall of the wellbore 102 and the outer surface of the casing 108. Details on an example installation implementation are given later within this disclosure. In general, the first coupler portion 118*a* can be installed in a variety of ways so long as it is capable of coupling with the second coupling portion 118*b*. For example, the first coupler portion 118*a* can be cemented in place. In some implementations, the first coupler portion 118*a* can be strapped to the side of the casing 108. While illustrated as being positioned between a wall of the wellbore 102 and the outer surface of the casing 108, the first coupler portion 118*a* can be positioned in other parts of the wellbore; for example, the first coupler portion 118*a* can be strapped to the outer surface of any downhole tubular, such as a liner, casing, or production tube. In some implementations, the first power coupler portion 118*a* can be positioned between the production tubing and the casing 108 or a liner. In some implementations, the first coupler portion 118*a* can be integrated into a downhole tubular. In some implementations, the first coupler portion 118*a* can be located partially on the outer surface of a tubular and partially on an inner surface of the same tubular. In some implementations, a portion of the tubing can house at least a portion of the first coupler portion 118*a*. That is, the first coupler portion 118*a* can be integrated into a tubular, such as the casing 108. In some implementations, the first coupler portion 118*a* can be located outside a separate tube (not the casing and not the production tube) where it is sealed from exposure to production fluid by this separate tube, whose construction is of a non-metallic material. This tube can be attached to the casing. In some implementations, the second coupler can be located in the production tube, deployed in the production fluid (close to the surface for easy replacement), while the first coupling is located between the casing and production tube and receiving power from the second coupling and transmitting current to the device stator to operate the motor, thus the first coupler is isolated from the production fluid.

In some implementations, the multi-phase, inductive coupling second portion 118*b* is positioned between an inner surface of a casing 108 and the outer surface of the production tubing 114. In some implementations, the multi-phase, inductive coupling second portion 118*b* is positioned between an inner surface of a casing 108 and the outer surface of the artificial lift device 112. In some implementations, the multi-phase, inductive coupling second portion 118*b* can be integrated into the artificial lift device 112. In some implementations, the second coupling portion 118*b* can be integrated into either the artificial lifting device 112, the production tubing 114, the casing 108, or any combination. In general, the second coupling portion, as illustrated, can be included with a retrievable portion of the well system 100. In some implementations, the artificial lift device can be a part of the casing. Such an implementation is described later within this disclosure.

Regardless of the implementation, the first portion 118*a* and the second portion 118*b* of the multi-phase inductive power coupler 118 is configured to transfer multiphase power between the first portion 118*a* and the second portion 118*b*. In general, the multi-phase, inductive coupling first portion 118*a* and the second portion are configured to transfer high power loads, for example to drive an ESP or downhole compressor motor.

The artificial lift device 112 includes a motor with an electric stator. The motor can be a synchronous permanent magnet motor. In such an implementation, the motor includes a rotor with permanent magnets arranged around the outside and multiple windings in a stator. The motor is a multiphase motor. In some implementations, induction motors or other electric drive systems can be used without departing from this disclosure. The electric stator is configured to induce a rotary motion in an electric rotor by an electromagnetic field. The electric rotor is coupled to a fluid rotor to impart kinetic energy onto the production fluid. The multi-phase inductive coupler second portion 118*b* is electrically coupled to windings within the electric stator.

Figure 2:
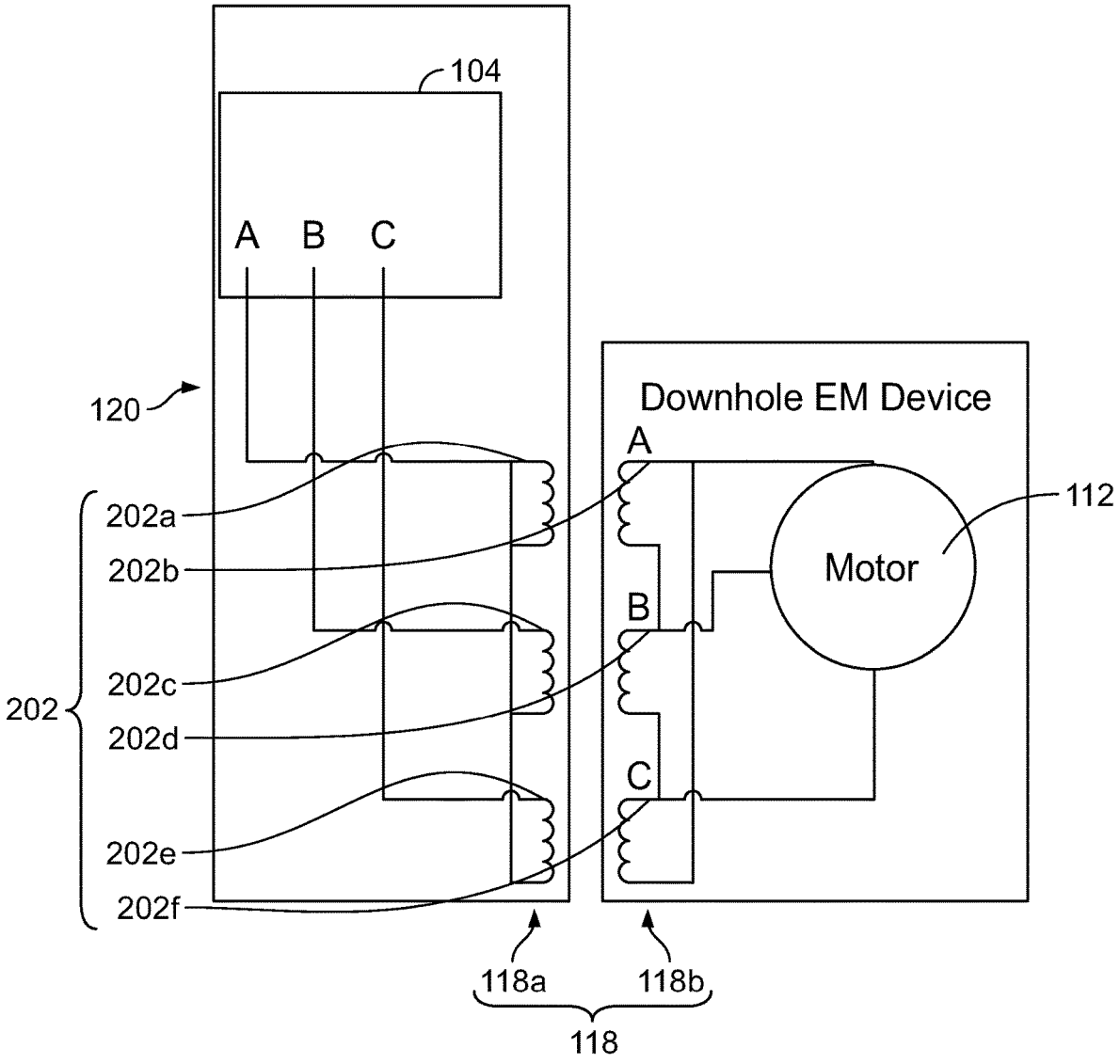
FIG. 2 is a schematic wiring diagram of the well system of FIG. 1.

FIG. 2 is a schematic wiring diagram of the well system of FIG. 1. The power supplied from the topside facility 104 in multiple phases. In a symmetric multi-phase system, multiple conductors each carry an alternating current of the same frequency and voltage amplitude relative to a common reference, but with an equal phase difference from one another (for example in a 3 phase system phase B is 120 degrees lagging from phase A, and phase C is 240 degrees lagging from phase A). A common reference can be connected to ground or to a current-carrying conductor called the neutral. Due to the phase difference, the voltage on any conductor reaches its peak at 1/n, where n is the number of phases, of a cycle within a first conductor, and a peak at another 1/n of the next conductor, continuing through the remaining conductors. This phase delay gives constant power transfer to a balanced load. It also makes it possible to produce a rotating magnetic field in an electric motor. The amplitude of the voltage difference between two phases is the square root of the number of phases times the amplitude of the voltage of the individual phases.

The multi-phase systems described within this disclosure are symmetric multiphase systems, and are simply referred to as multi-phase systems because, although it is possible to design and implement asymmetric three-phase power systems (i.e., with unequal voltages or phase shifts), they are not used in practice because they lack the most important advantages of symmetric systems.

As illustrated, the multi-phase, inductive first portion 118*a* and the multi-phase, inductive second portion 118*b* are both 3-phase. That is, the multi-phase, inductive coupler is a 3-phase inductive coupler. While illustrated as a 3-three phase coupling, greater or fewer phases can be used without departing from this disclosure. Each phase of the 3-phase inductive coupler corresponds to an individual phase of the motor. Each phase of each coupling portion includes its own inductive coil 202. Each inductive coil 202 is configured to inductively couple with a corresponding inductive coil when the corresponding coils are in proximity to one another. For example, inductive coil 202*a* corresponds to inductive coil 202*b*. A first phase of power is exchanged between the inductive coil 202*a* which corresponds to inductive coil 202*b* during operation. For such an exchange to occur, the inductive coil 202*a* and the inductive coil 202*b* are close enough together for sufficient coupling to occur. An inductive coil 202*c* corresponds to inductive coil 202*d*. A second phase of power is exchanged between the inductive coil 202*c* which corresponds to inductive coil 202*d* during operation. For such an exchange to occur, the inductive coil 202*c* and the inductive coil 202*d* are close enough together for sufficient coupling to occur. An inductive coil 202*e* corresponds to inductive coil 202*f*. A third phase of power is exchanged between the inductive coil 202*e* which corresponds to inductive coil 202*f* during operation. For such an exchange to occur, the inductive coil 202*e* and the inductive coil 202*f* are close enough together for sufficient coupling to occur. In general, corresponding pairs of coils are isolated from other corresponding pairs of coils to prevent cross-talk between phases. Such isolation can be done with shielding, coil orientation, and/or coil positioning. Coils are spatially isolated either by axially spacing or radial spacing the coils from each other. For example, a non-metallic barrier can be positioned between coils. The non-metallic barrier can be used to separate production fluid zones form non-production fluid zones, and can offer increased efficiency by eliminating magnetic and eddy current losses generated by the coils. This type of barrier also minimizes conduction in the barrier that would enhance cross talk. When using a barrier that can allow conduction, greater spacing between coils can be used to minimize this effect. Coil arrangement can be done in multiple ways that are best suited for the application and integration with well applications and the availability of long lengths. Cooperating coils though are aligned to allow for proper and efficient power transfer form one coil to the other.

In some implementations, each phase comprises a sinusoidal waveform, with each phase being offset from one another by substantially 120° within typical power distribution tolerances. In general, there is an equal phase shift for each phase in the multi-phase power transmission. That is, a full phase (360°) divided by the number of phases. For example, a four phase power system would have each phase offset from one another by 90° within typical power distribution tolerances. In some implementations, other waveforms, such as a trapezoidal waveform, can be used without departing from this disclosure. In some implementations, a switching power supply can be used at the topside facility. In such an implementation, pulse width modulation can be used to approximate the waveforms for each phase of power. In some implementations, the switching power supply can be located within the wellbore 102, and can be supplied power separately from the topside facility.

In general the power provided through the multi-phase coupling 118 is the only power to the artificial lift device 112. That is, the multi-phase coupling 118 supplies all the power needed to operate the artificial lift to a specified lift rate. A specified lift rate is a flowrate, pressure or combination, sufficient to produce fluids such that the well system 100 is economically viable. In addition motor power, operating speed, thrust load, and fluid conditions and composition can all be used to determine a desired device operation based on the flowrate being produced. In some implementations, additional power coupling can be included to supply ancillary downhole systems. These couplings can convey power, in the form of single phase or multiple phase, low or high frequency, high or low voltage, for downhole devices such as magnetic bearings (i.e. a thrust magnetic bearing) and sensors such as position, temperature, pressure, and flow. They can also be used for signal transmission either through an independent or dedicated coupler for one or multiple signals (positions, temperatures, pressures, etc.) or these signals can be used on the same coupler (i.e. piggy backed) used for power transmission to the motor.

Figure 3:
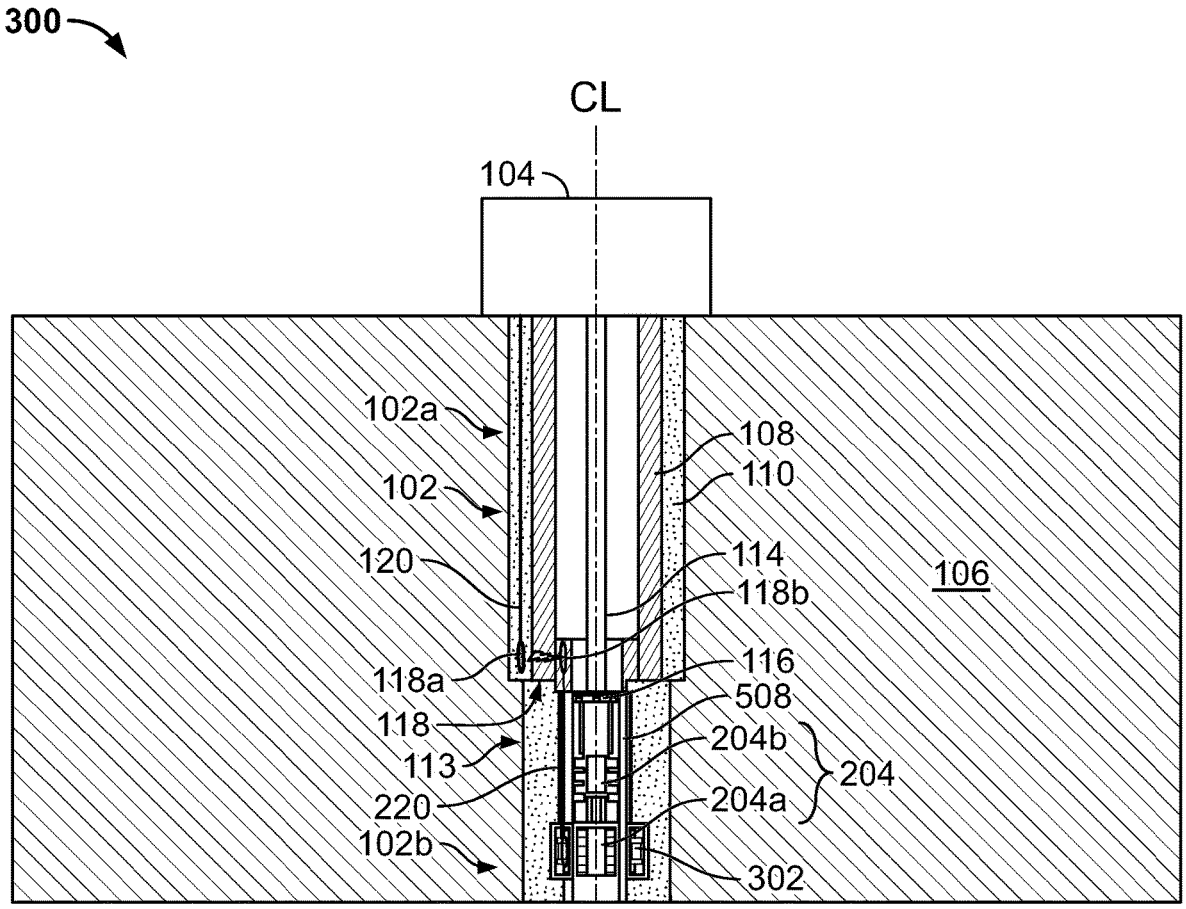
FIG. 3 is a half-cross sectional diagram of an example well system that can be used with aspects of this disclosure.

FIG. 3 is a half-cross sectional diagram of an example well system 300 that can be used with aspects of this disclosure. In general, the well system 300 is similar to the well system 100 with differences described herein. In this implementation, an artificial lift device 113 is used in lieu of the artificial lift device 112. The artificial lift device 113 includes a permanently installed electric stator 302 that is cemented in place with a second casing portion 508. In such an implementation, a rotor 204 can be separately retrievable from the wellbore 102. The rotor 204 can include an electric rotor 204*a* and a fluid rotor 204*b* that are rotably coupled to one another and can be retrievable as a single unit. In such an implementation, the electric rotor-impeller 204 is supported to rotate within the stator 302.

In the illustrated implementation, power is transferred between the topside facility 104 and the first coupling portion 118*a* down the first power cable 120, similar to well system 100 (FIG. 1). As explained previously, the first coupling portion 118*a* and the second coupling portion 108*b* can be installed in a variety of locations so long as power can be transferred and/or exchanged between the first coupling portion 118*a* and the second coupling portion 118*b*. In this implementation, as illustrated, the second coupling portion is housed within a second casing portion 508. In general, for this implementation, the second coupling portion is permanently installed within the wellbore. The second coupling portion 118*b* is electrically connected to the permanently installed stator 302 by a second power cable 220.

Figure 4:
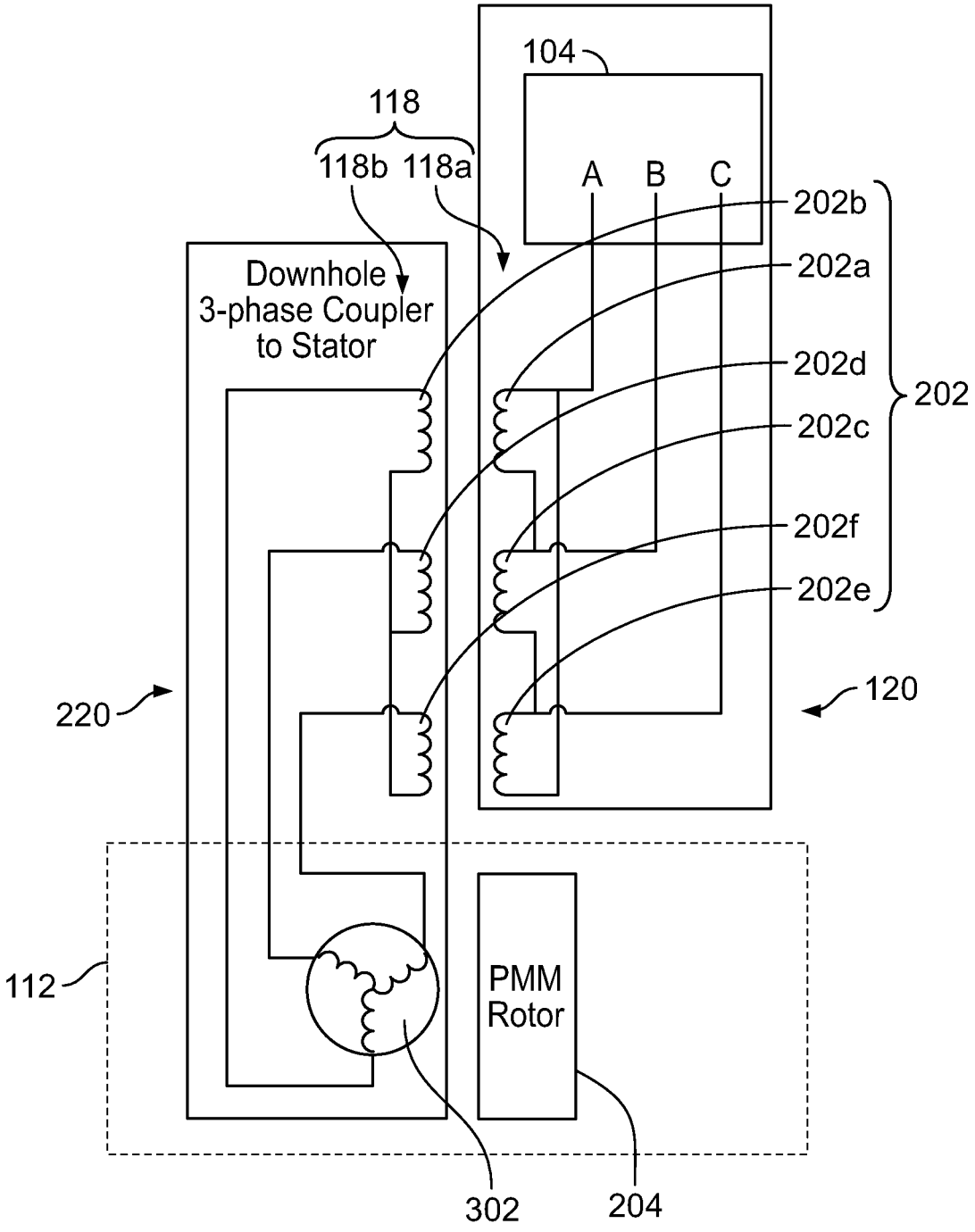
FIG. 4 is a schematic wiring diagram of the well system of FIG. 3.

FIG. 4 is a schematic wiring diagram of the well system of FIG. 3. In general, the wiring diagram illustrated in FIG. 4 is similar to the wiring diagram illustrated in FIG. 2, with differences described herein. Once power is transferred via the coupling 118 from the topside facility 104, it is transmitted to electrical windings in the permanently installed stator 302 by the second power cable 220. The permanently installed windings then induce a rotation within the rotor 204 when the windings are energized.

Figure 5:
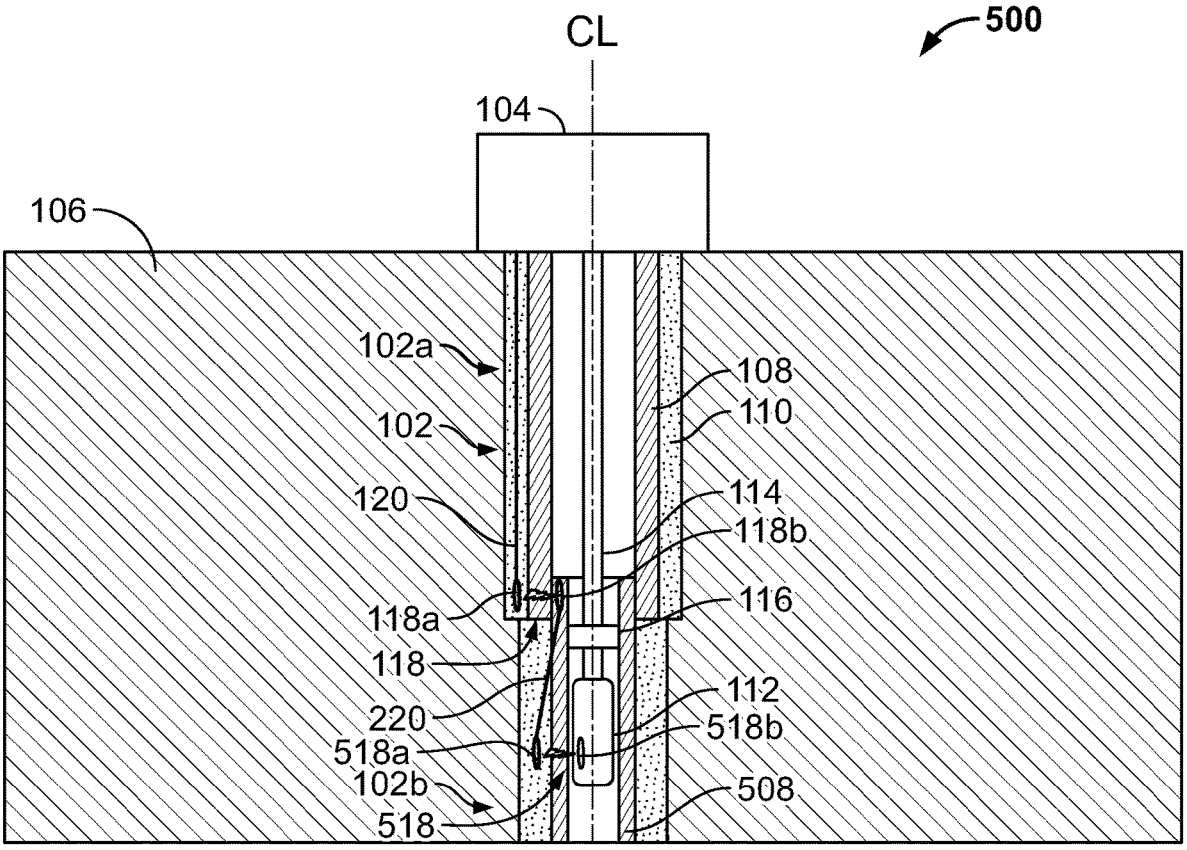
FIG. 5 is a half-cross sectional diagram of an example well system that can be used with aspects of this disclosure.

As wells become deeper, additional multi-phase inductive power couplings may be used. Such an implementation is shown in FIG. 5, which is a half-cross sectional diagram of an example well system 500 that can be used with aspects of this disclosure. The well system 500 is similar to the well system 100, with differences described herein. The well system 500 includes a second casing portion 508 that has a diameter less than that of the first casing portion 108. The second casing portion 508 extends from the downhole end of the first casing section 108 deeper into the subterranean zone 106. The artificial lift device 112 and the combination packer/hanger 116 are positioned within the second casing portion 508.

The first casing portion 108 and the second casing portion 508 can be connected in a variety of ways. For example, the two casing sections can be threaded together, welded together, be connected by a casing hanger, be cemented in place, or attached by any other acceptable well construction methods. An example of a casing interface is provided later within this disclosure. The couplings can be aligned axially or azimuthally depending on the connection method and implementation of the coupling coils. For example, the coupling coils can be held in an extension of the casing to allow for alignment and coupling to the matching coils of the lower coil set. In some implementations, one set of coils can be positioned in the box of a tubular and one set of coils can be positioned within the pin of a second, corresponding tubular, so that the coupler portions are axially they are aligned. The moment of the coil can be in the axial direction. The moment of the coils can also be in the direction orthogonal to the axial direction. In this case, the transmitter and receiver coils have to align radially. Such an alignment can be done by keying the tubulars, embedding the coils such that the threads on the first tubular and the second tubular alight the coupling portions when engaged at a specified torque or position, or by any other method.

As illustrated, the first coupling portion 118*a* of the first multi-phase coupler 118 is positioned within the cement between an outer surface of the first casing portion 108 and a wall of the wellbore 102. As previously described, the first coupling portion 118*a* can be located in a variety of locations so long as power is able to be transmitted between the first coupling portion 118*a* and the second coupling portion 118*b*, i.e. the coupling on the outside of one casing and embedded in the middle of the other.

As illustrated, the multi-phase, inductive coupling second portion 118*b* is positioned within the second casing portion 508. In some implementations, the multi-phase, inductive coupling second portion 118*b* is positioned between an inner surface of a casing 108 and the outer surface of the second casing portion 508. In some implementations, the second coupling portion 118*b* can be integrated into either the production tubing 114, the first casing portion 108, the second casing portion 508, or any combination. In general, the second coupling portion, as illustrated, can be included with a permanently installed portion of the well system 500.

In this implementation, the second portion 118*b* of the first multi-phase inductive coupler 118 is electrically connected to a second coupler 518 by a second power cable 220. In some implementations the second power cable 220 is substantially similar to the one or more power cables 120. The second power cable 220 can be positioned in a variety of places without departing from this disclosure. For example, the second power cable 220 can be positioned between a wall of the wellbore 102 and an outer surface of the second casing portion 508. In some implementations, the second power cable 220 can be cemented in place. In some implementations, the second power cable 220 can be strapped to the side of the second casing portion 508. The second power cable 220 can be strapped to the outer surface of any downhole tubular, such as a liner, casing, or production tube. In some implementations, the one or more power cables can be positioned between the production tubing and the second casing portion 508 or a liner. In some implementations, the second power cable 220 can be integrated into a downhole tubular. In some implementations, the second power cable 220 can be located partially on the outer surface of a tubular and partially on an inner surface of the same tubular. In some implementations, multiple tubulars can be connected together, and the one or more power cables can be located on an outer surface of the multiple tubulars, on the inner surface of the multiple tubulars, or any combination across the multiple tubulars. As illustrated, the second power cable is partially housed within the second casing portion 508, and partially runs on an outer surface of the second casing portion 508.

The second multi-phase inductive coupler first portion 518*a* of is permanently installed within the wellbore. The multi-phase inductive coupler first portion 518*a* can be installed in a variety of ways, such as being cemented into the wellbore 102 within the annulus defined by the wall of the wellbore 102 and the outer surface of the casing 508. Details on an example installation implementation are given later within this disclosure. In some implementations, the multi-phase, inductive coupling second portion 518*b* is positioned between an inner surface of the second casing portion 508 and the outer surface of the production tubing 114. In some implementations, the second multi-phase, inductive coupling second portion 518*b* is positioned between an inner surface of the second casing portion 508 and the outer surface of the artificial lift device 112. In some implementations, the multi-phase, inductive coupling second portion 518*b* can be integrated into the artificial lift device 112. The second multi-phase inductive coupler second portion 518*b* is electrically coupled to windings within the electric stator.

Regardless of the implementation, the first portion 518*a* and the second portion 518*b* of the multi-phase inductive power coupler 518 is configured to transfer multiphase power between the first portion 518*a* and the second portion 518*b*. In general, the multi-phase, inductive coupling second portion is configured to transfer high power loads, for example to drive an ESP or downhole compressor motor.

Figure 6:
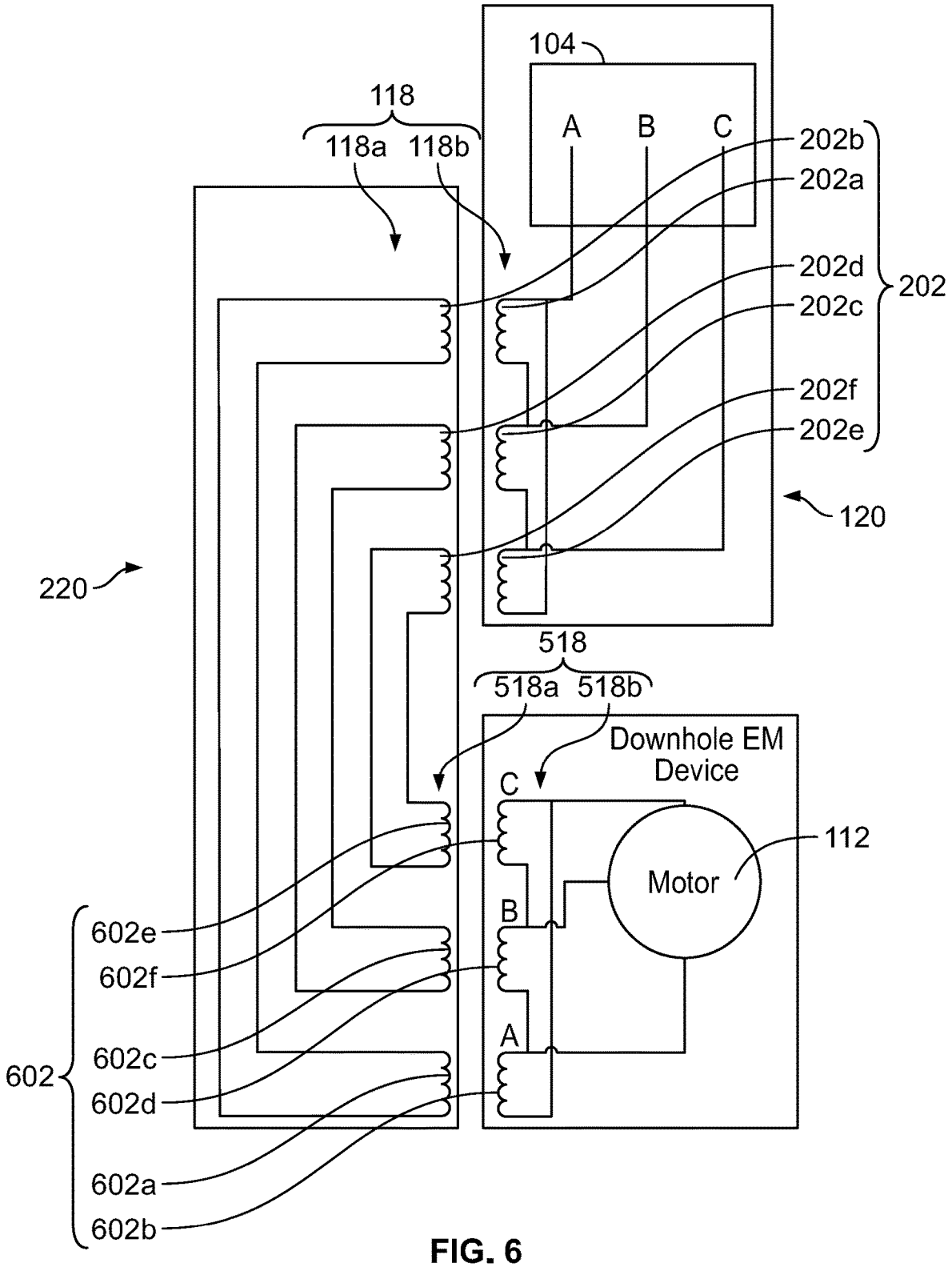
FIG. 6 is a schematic wiring diagram of the well system of FIG. 5.
Figure 7:
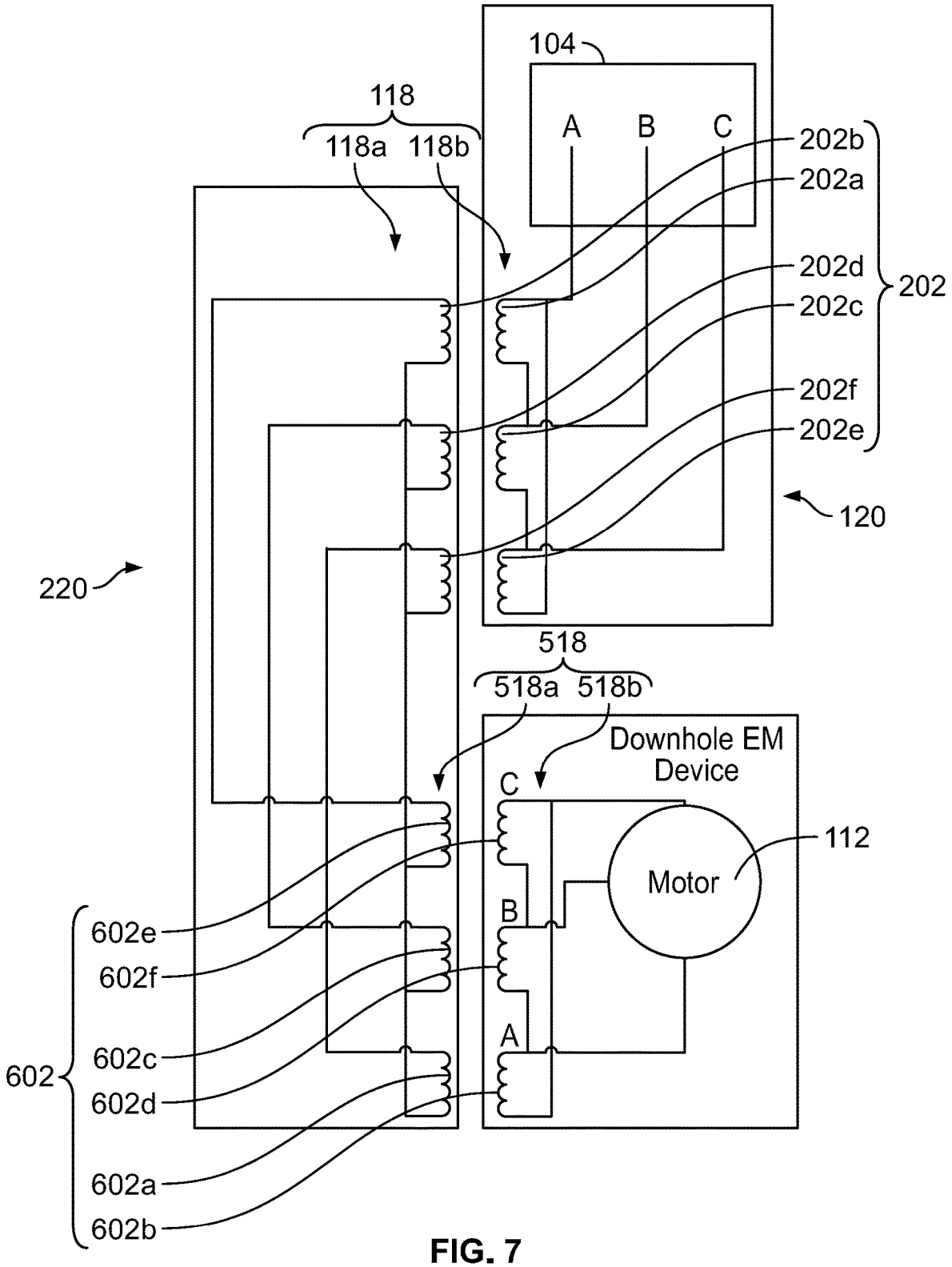
FIG. 7 is a schematic wiring diagram of the well system of FIG. 5.

FIGS. 6-7 are schematic wiring diagrams of the well system of FIG. 5. In general, the wiring diagram illustrated in FIGS. 6-7 is similar to the wiring diagram illustrated in FIG. 2, with differences described herein. The second multi-phase, inductive first portion 518*a* and the multi-phase, inductive second portion 518*b* are both 3-phase. That is, the second multi-phase, inductive coupler 518 is a 3-phase inductive coupler. While illustrated as a 3-three phase coupling, greater or fewer phases can be used without departing from this disclosure. Details on such 3-phase couplers have been previously described.

Regarding the second coupler 518, each phase of each coupling portion includes its own inductive coil 602. Each inductive coil 602 is configured to inductively couple with a corresponding inductive coil when the corresponding coils are in proximity to one another. For example, inductive coil 602*a* corresponds to inductive coil 602*b*. A first phase of power is exchanged between the inductive coil 602*a* which corresponds to inductive coil 602*b* during operation. For such an exchange to occur, the inductive coil 602*a* and the inductive coil 602*b* are close enough together for sufficient coupling to occur. An inductive coil 602*c* corresponds to inductive coil 602*d*. A second phase of power is exchanged between the inductive coil 602*c* which corresponds to inductive coil 602*d* during operation. For such an exchange to occur, the inductive coil 602*c* and the inductive coil 602*d* are close enough together for sufficient coupling to occur. An inductive coil 602*e* corresponds to inductive coil 602*f*. A third phase of power is exchanged between the inductive coil 602*e* which corresponds to inductive coil 602*f* during operation.

In some implementations, such as the implementation shown in FIG. 7, a common line can be used between one or more coils. A common line connects all of the phases so that they maintain the same voltage relative on one another. In symmetric multi-phase systems, phase currents tend to cancel out one another, summing to zero in the case of a linear balanced load. This makes it possible to reduce the size of the common line because it carries little or no current. This configuration allows for reduced number of conductors for smaller cable size. It can result in cross coupling between phases and/or high common line currents if there are phase imbalances due to coupling misalignment or unbalanced phase source voltages. As a result, either configuration can be used depending upon the expected operating conditions of the downhole equipment and the topside power. In some implementations, one portion of a coupler can have a common line, and another portion of a coupler can be lacking a common line. In some implementations, both coupling portions can be lacking a common line. In some implementations, both coupling portions can include a common line.

Figure 8:
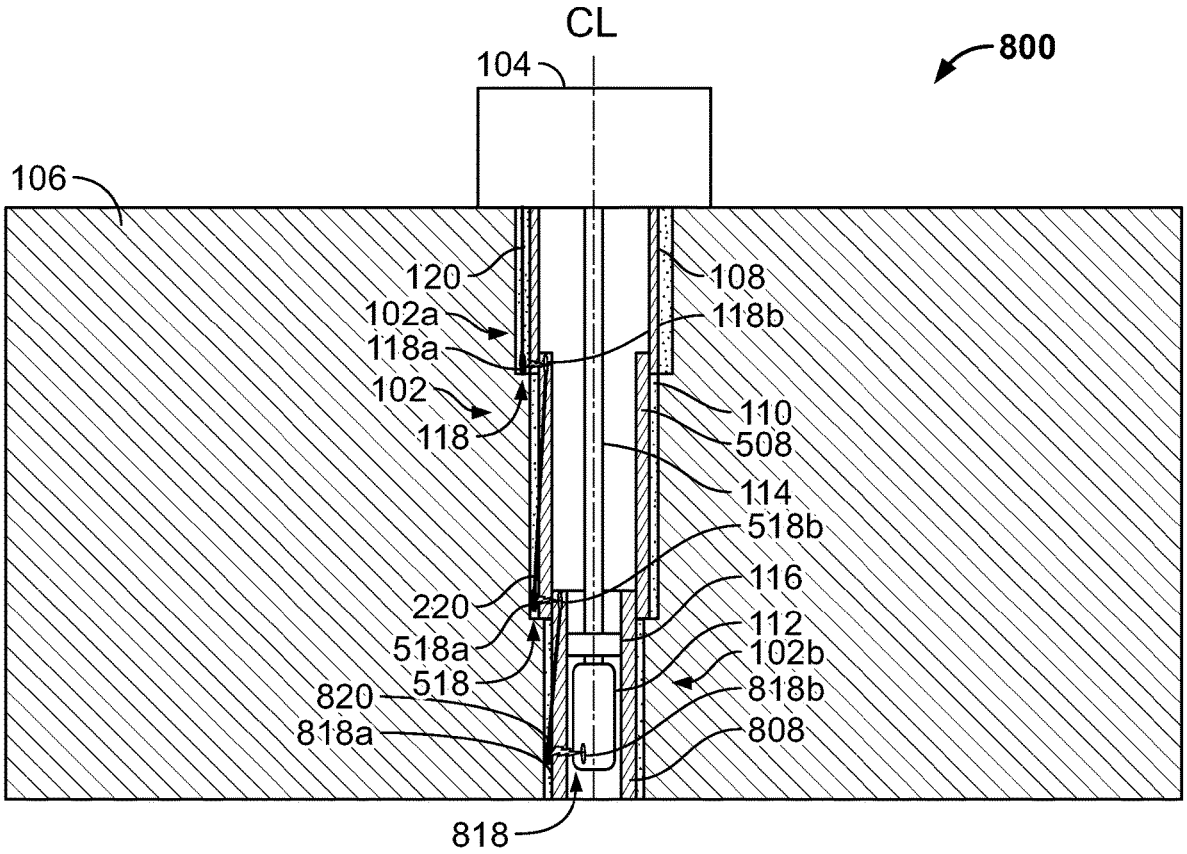
FIG. 8 is a half-cross sectional diagram of an example well system that can be used with aspects of this disclosure.

FIG. 8 is a half-cross sectional diagram of an example well system 800 that can be used with aspects of this disclosure. The well system 800 is similar to the well system 500, with differences described herein. The well system 800 includes a third casing portion 808 that has a diameter less than that of the first casing portion 108 and less than the second casing portion 508. The third casing portion 808 extends from the downhole end of the second casing section 508 deeper into the subterranean zone 106. The artificial lift device 112 and the combination packer/hanger 116 are positioned within the third casing portion 808.

In this implementation, the second portion 518*b* of the second multi-phase inductive coupler 518 is electrically connected to a third coupler 818 by a third power cable 820. More specifically, the second portion 518*b* of the second multi-phase inductive coupler 518 is electrically connected to a first portion 818*a* of the third inductive electrical coupler 818. The third multi-phase inductive coupler first portion 818*a* of is permanently installed within the wellbore 102. The multi-phase inductive coupler first portion 818*a* can be installed in a variety of ways, such as being cemented into the wellbore 102 within the annulus defined by the wall of the wellbore 102 and the outer surface of the casing 808. Details on an example installation implementation are given later within this disclosure. In some implementations, the multi-phase, inductive coupling second portion 818*b* is positioned between an inner surface of the second casing portion 808 and the outer surface of the production tubing 114. In some implementations, the second multi-phase, inductive coupling second portion 818*b* is positioned between an inner surface of the third casing portion 808 and the outer surface of the artificial lift device 112. In some implementations, the multi-phase, inductive coupling second portion 818*b* can be integrated into the artificial lift device 112. The third multi-phase inductive coupler second portion 818*b* is electrically coupled to windings within the electric stator.

Regardless of the implementation, the first portion 818*a* and the second portion 818*b* of the multi-phase inductive power coupler 818 are configured to transfer multiphase power between the first portion 818*a* and the second portion 818*b*. In general, the multi-phase, inductive coupling second portion are configured to transfer high power loads, for example to drive an ESP or downhole compressor motor.

While a maximum of three casing segments are illustrated within this disclosure, it should be recognized that a greater number casing segments and a greater number of inductive couplers can be used without departing from this disclosure. Alternatively or in addition, there can be intervening casing-to-artificial lift device inductive couplings where the power is split and sent partially to the artificial lift device, and partially sent down the casing to another casing-to-casing coupler, or another casing-to artificial lift device coupler.

Figure 9:
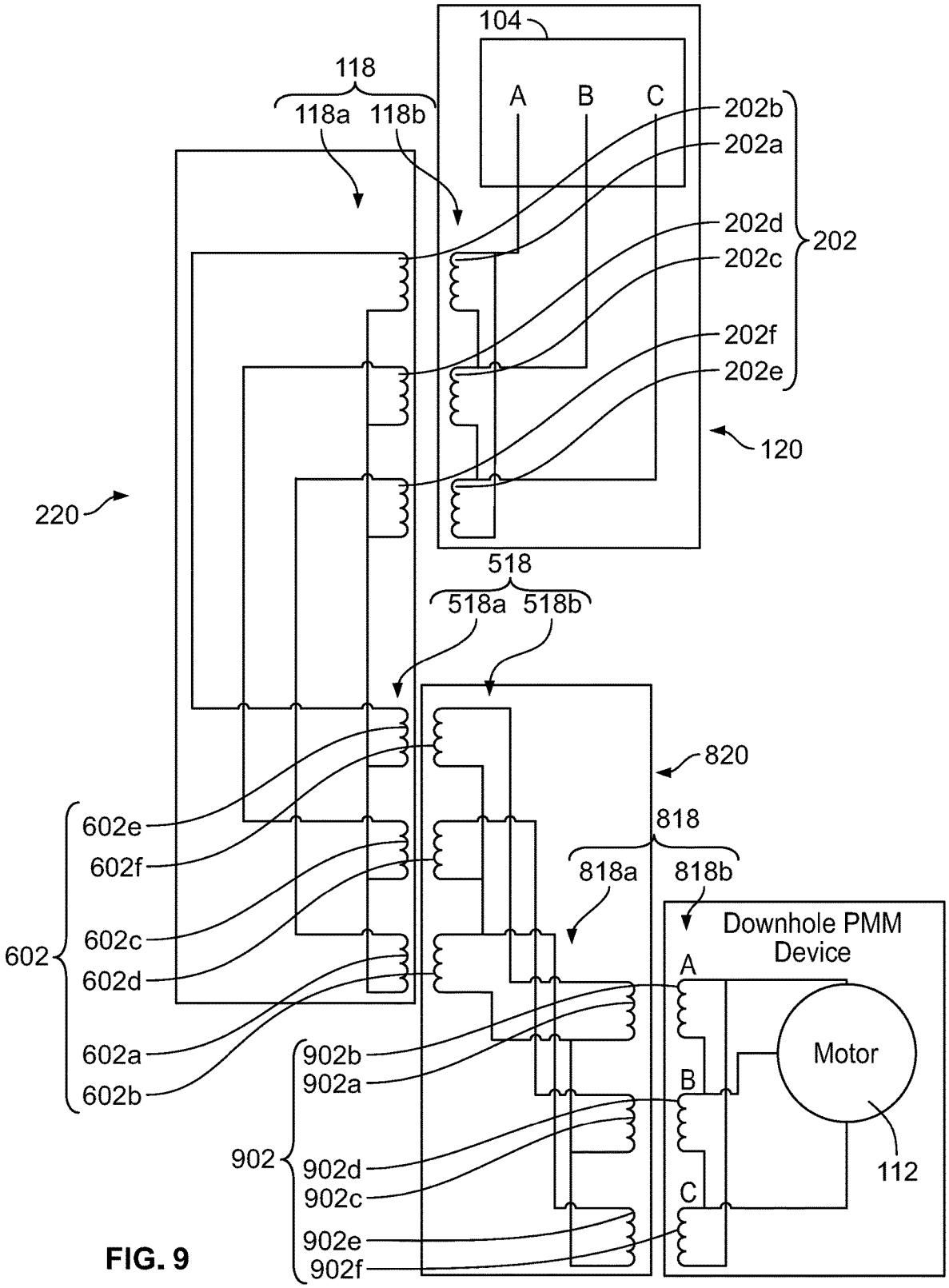
FIG. 9 is a schematic wiring diagram of the well system of FIG. 8.

FIG. 9 is a schematic wiring diagram of the well system of FIG. 8. As illustrated, the first multi-phase coupler 118 and the second multi-phase coupler 518 are similar to previously described implementations, such as those in FIGS. 6-7. The third multi-phase, inductive first portion 818*a* and the multi-phase, and inductive second portion 818*b* are both 3-phase. That is, the third multi-phase, inductive coupler 818 is a 3-phase inductive coupler. While illustrated as a 3-three phase coupling, greater or fewer phases can be used without departing from this disclosure.

Regarding the third coupler 818, each phase of each coupling portion includes its own inductive coil 902. Each inductive coil 902 is configured to inductively couple with a corresponding inductive coil when the corresponding coils are in proximity to one another. For example, inductive coil 902*a* corresponds to inductive coil 902*b*. A first phase of power is exchanged between the inductive coil 902*a* which corresponds to inductive coil 902*b* during operation. For such an exchange to occur, the inductive coil 902*a* and the inductive coil 902*b* are close enough together for sufficient coupling to occur. An inductive coil 902*c* corresponds to inductive coil 902*d*. A second phase of power is exchanged between the inductive coil 902*c* which corresponds to inductive coil 902*d* during operation. For such an exchange to occur, the inductive coil 902*c* and the inductive coil 902*d* are close enough together for sufficient coupling to occur. An inductive coil 902*e* corresponds to inductive coil 902*f*. A third phase of power is exchanged between the inductive coil 902*e* which corresponds to inductive coil 902*f* during operation. For such an exchange to occur, the inductive coil 902*e* and the inductive coil 902*f* are close enough together for sufficient coupling to occur.

Figure 10:
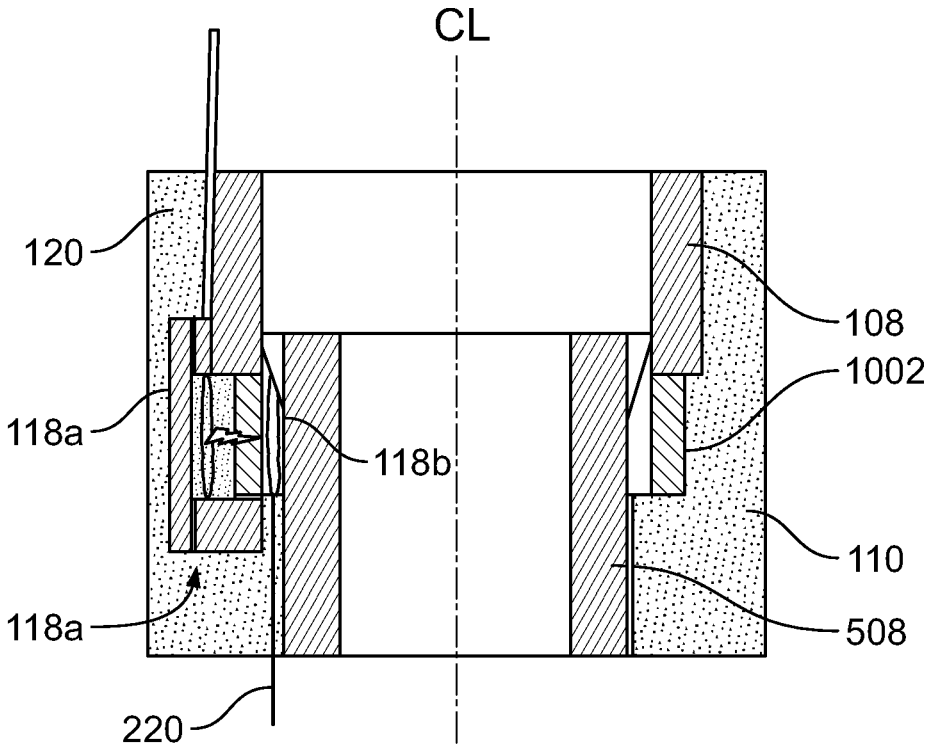
FIG. 10 is a half-cross sectional diagram of an inductive coupling assembly installed in a well.

FIG. 10 is a half-cross sectional diagram of an inductive coupling assembly installed in a well. The figure is described in the context of the implementation illustrated in FIG. 5, but the details described herein are applicable to all implementations within this disclosure. As illustrated the inductive coupling first portion 118*a* is positioned within a wall of casing 108 while the second portion is positioned between an inner surface of a casing 108 and an outer surface of the casing 508.

As illustrated, the casing 108 includes a transmission portion 1002 configured to increase a power transmission efficiency when compared to a remaining portion of the casing 108. The increased transmission efficiency can be accomplished in a number of ways. In some implementations, the transmission portion 1002 has a reduced wall thickness when compared to the remaining portion of the casing 108. In some implementations, the transmission portion includes a non-magnetic material, such as Inconel or a 300 series stainless steel. In some implementations, the transmission portion can include nonmetallic materials, such as fiberglass, carbon fiber, PEEK, ceramics, or any combination of these. In some implementations, a combination of geometry and materials can be used to maintain pressure integrity while increasing transmission efficiency. For example, in some implementations, the first portion 118*a* can be fully encased by the transmission portion 1002 on a first side and by a pressure-retaining casing on remaining sides. That is, an additional layer of protection can be added (not shown) to maintain structural integrity. In such an instance, the additional pressure-retaining casing is configured to retain pressure within the tubular.

A number of implementations of the subject matter have been described. Nevertheless, it will be understood that various modifications may be made without departing from the spirit and scope of the subject matter described herein. For example, while the multi-phase inductive coupler have been primarily described and exchanging power across casing, similar principles can be used to exchange power across any wellbore tubular, such as production tubing. While powering a downhole motor in an ESP has been used as the primary example within this disclosure, the subject matter described herein is applicable to other artificial lift devices, such as downhole compressors or blowers. Alternatively or in addition, the subject matter described within this disclosure can also be applied to a downhole-type generator. While specific examples have been provided regarding specific numbers of inductive couplers, any number of inductive couplers can be used within a well completion depending on the power transmission and depth required. Even though specific examples regarding common lines within the inductive couplers have been provided, the use or lack of a common line does not depart from this disclosure. Accordingly, other implementations are within the scope of the following claims.

What is claimed is:

1. A downhole-type artificial lift component, comprising:

a wellbore tubular;

a multi-phase, inductive coupling first portion carried by the tubular, the coupling first portion configured to inductively transmit current with a corresponding multi-phase, inductive coupling second portion;

a downhole-type electric stator carried by the tubular and configured to receive and electromagnetically interact with a retrievable electric rotor-impeller, the coupling first portion electrically connected to windings of the stator;

the retrievable electric rotor-impeller configured to be at least partially carried within the electric stator, the electric rotor-impeller configured to be retrievable from a well separately from the electric stator;

a multi-phase, inductive coupling third portion conductively connected in series, by a power cable, to the multi-phase, inductive coupling second portion, the multi-phase, inductive coupling third portion being at an opposite end of the well tubular as the multi-phase, inductive coupling second portion; and a multi-phase, inductive coupling fourth portion configured to inductively transmit current with the corresponding multi-phase, inductive coupling third portion.

2. The downhole-type artificial lift component of claim 1, further comprising the corresponding multi-phase, inductive coupling second portion electrically connected to a power source at a topside facility, the corresponding multi-phase, inductive second coupling portion positioned on a side of the tubular.

3. The downhole-type artificial lift component of claim 1, wherein each phase of one of the multi-phase inductive couplings share a common line.

4. The downhole-type artificial lift component of claim 1, wherein the multi-phase, inductive first coupling portion and the multi-phase, inductive coupling second portion are both 3-phase.

5. The downhole-type artificial lift component of claim 1, wherein the tubular is a casing and the multi-phase, inductive coupling second portion is positioned between a wall of a wellbore and the casing.

6. The downhole-type artificial lift component of claim 1, wherein the tubular is a production tubing and the multi-phase, inductive coupling second portion is positioned between an inner surface of a casing and the production tubing.

7. The downhole-type artificial lift component of claim 1, wherein the tubular comprises:

a transmission portion configured to increase a power transmission efficiency when compared to a remaining portion of the tubular.

8. The downhole-type artificial lift component of claim 7, wherein the transmission portion comprises a non-magnetic material.

9. The downhole-type artificial lift component of claim 7, wherein the transmission portion comprises a non-metallic material.

10. The downhole-type artificial lift component of claim 7, wherein the transmission portion has a reduced wall thickness when compared to the remaining portion of the tubular.

11. The downhole-type artificial lift component of claim 10, wherein the multi-phase, inductive coupling second portion is encased by the transmission portion on a first side and by a pressure retaining casing on remaining sides, the pressure retaining casing configured to retain pressure within the tubular.

12. A downhole-type artificial lift component, comprising:

a wellbore tubular;

a multi-phase, inductive coupling first portion carried by the tubular;

a multi-phase, inductive coupling second portion, the multi-phase, inductive coupling first portion configured to inductively transmit current with the multi-phase, inductive coupling second portion;

a downhole-type electric stator carried by the tubular and configured to receive and electromagnetically interact with an electric rotor-impeller, the coupling first portion electrically connected to windings of the stator;

a multi-phase, inductive coupling third portion conductively connected in series to the multi-phase, inductive coupling second portion; and a multi-phase, inductive coupling fourth portion configured to inductively transmit current with the corresponding multi-phase, inductive coupling third portion.

13. The downhole-type artificial lift component of claim 12, further comprising:

a first casing section; and a second casing section, the multi-phase, inductive coupling fourth portion positioned at an uphole end of first casing, the multi-phase, inductive coupling third portion positioned at a downhole end of the second casing section, the multi-phase, inductive coupling fourth portion and the multi-phase, inductive coupling third portion configured to be positioned in proximity adjacent to one another once installed, the multi-phase, inductive second portion positioned at an uphole end of the second casing.

14. The downhole artificial lift component of claim 12, wherein the multi-phase, inductive coupling third portion is at an opposite end of the well tubular as the multi-phase, inductive coupling second portion.

15. The downhole artificial lift component of claim 12, wherein the first multi-phase, inductive coupling first portion, the multi-phase, inductive coupling second portion, the multi-phase inductive coupling third portion, and the multi-phase inductive fourth portion are all rated to deliver sufficient power to drive the downhole-type electric stator.

16. A method comprising;

inductively transmitting current between a multi-phase, inductive coupling first portion and a multi-phase, inductive coupling second portion while the coupling portions are residing downhole;

inductively transmitting current between a multi-phase, inductive coupling third portion and a multi-phase, inductive coupling fourth portion, the multi-phase, inductive third portion being conductively connected to the multi-phase, inductive coupling second portion by a power cable;

conductively exchanging current between the multi-phase, inductive coupling first portion and windings of an electric stator; and supporting an electric rotor-impeller to rotate within the stator.

17. The method of claim 16, wherein the multi-phase, inductive coupling fourth portion is conductively connected to a topside power source.

18. The method of claim 16, wherein inductively transmitting comprises transmitting across a portion of a tubular.

19. The method of claim 18, wherein the portion of the tubular comprises a non-magnetic material.

20. The method of claim 18, wherein the portion of the tubular comprises a non-metallic material.

21. The method of claim 18, wherein the portion of the tubular comprises a thinner wall section in comparison with the rest of the tubular.

22. A downhole-type system comprising:

a wellbore tubular;

a multi-phase, inductive coupling first portion carried by the tubular;

a multi-phase, inductive coupling second portion, the first portion configured to inductively transmit current with the corresponding multi-phase, inductive coupling second portion;

a downhole-type electric stator carried by the tubular and configured to receive and electromagnetically interact with retrievable electric rotor-impeller, the coupling first portion electrically connected to windings of the stator;

the retrievable electric rotor-impeller configured to be carried within the electric stator, the electric rotor-impeller configured to be retrievable from a well separately from the electric stator;

a multi-phase, inductive coupling third portion conductively connected in series to the multi-phase, inductive coupling second portion by a power cable; and a multi-phase, inductive coupling fourth portion configured to inductively transmit current with the corresponding multi-phase, inductive coupling third portion.

23. The downhole-type system of claim 22, wherein the multi-phase, inductive coupling first portion and the multi-phase, inductive coupling second portion are both 3-phase.

* * * * *